US006364222B1

(12) United States Patent
Haltiner, Jr. et al.

(10) Patent No.: US 6,364,222 B1
(45) Date of Patent: Apr. 2, 2002

(54) INTEGRAL ARMATURE/SPACER FOR FUEL INJECTOR

(75) Inventors: Karl Jacob Haltiner, Jr., Fairport; Robert B. Perry, Leicester; Timothy P. Landschoot, Henrietta, all of NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/660,692

(22) Filed: Sep. 13, 2000

(51) Int. Cl.[7] ..... B05B 1/30; F02M 51/00
(52) U.S. Cl. ..... 239/585.1; 239/585.3
(58) Field of Search ..... 239/585.1, 585.2, 239/585.3, 585.4, 585.5, 533.9, 537, 541; 251/129.16

(56) References Cited

U.S. PATENT DOCUMENTS 4,908,731 A * 3/1990 Richeson, Jr. ..... 361/159
5,115,982 A * 5/1992 Mesenich ..... 239/585.3
5,170,766 A * 12/1992 Haas et al. ..... 123/531
5,857,446 A * 1/1999 Norton ..... 123/520

* cited by examiner

*Primary Examiner*—David A. Scherbel
*Assistant Examiner*—Davis Hwu
(74) *Attorney, Agent, or Firm*—John VanOphem

(57) ABSTRACT

An injector valve armature/spacer is formed as an integral tri-function multiple thickness member for an engine fuel injector. The member includes an armature having a center portion with an upper side engagable by a biasing spring and an outer portion with spaced radial openings extending outward from the center portion. An outer rim is connected to the inner portion of the armature by flexible legs extending radially through the radial openings. The rim has a thickness greater than that of the armature by a differential dimension establishing a stroke of the armature. The legs have a thickness less than that of the armature to permit flexing of the legs upon movement of the armature. The integral member is designed for manufacture in multiple layers using electroforming, optionally combined with metal etching.

8 Claims, 4 Drawing Sheets

INTEGRAL ARMATURE/SPACER FOR FUEL INJECTOR

TECHNICAL FIELD

This invention relates to solenoid actuated fuel injectors for engines and, more particularly, to an injection valve armature/spacer formed as an integral dual function multiple thickness member.

BACKGROUND OF THE INVENTION

It is known in the art relating to solenoid actuated engine fuel injectors to provide a disk-like armature biased against a valve seat to cut off fuel flow and attractable to inner and outer magnetic poles to permit flow through the valve seat. A separate spacer may be provided to establish the stroke of the armature to control the rate of fuel flow. Flexible legs may be attached to the armature to guide its motion within a valve body and minimize friction during opening and closing motion. Typically, an armature includes multiple components requiring individual forming and machining or other processing and requiring assembly in an injector with other components to form a completed structure ready for use. A simpler armature assembly involving less costly or reduced processing steps is desired.

SUMMARY OF THE INVENTION

The present invention provides an improved and simplified armature/spacer member, which combines in an integral unit the functions of an armature and a stroke setting spacer. The member is preferably made using electroforming and/or metal etching processes. The member may be made in layers with differing materials, if desired, and with differing thicknesses to best accomplish the purposes of the integral member.

In a preferred embodiment, an injection valve armature/spacer, is formed as an integral tri-function multiple thickness valve member for an engine fuel injector. The member includes an armature having a center portion with an upper side engagable by a biasing spring and an outer portion with spaced radial openings extending outward from the center portion. An outer rim is spaced outward of the armature and is connected to it by a plurality of flexible legs extending radially in the radial openings from the center portion of the armature to the rim.

The legs are flexible axially but stiff radially to maintain the radial position of the armature while allowing it to move axially between lower and upper positions that respectively open and close a valve seat. The rim positions the legs and also acts as a spacer that established the armature stroke. Thus, the integral member functions as a valve member, armature guide and stroke setting spacer.

The armature has a flat lower surface engagable with the valve seat and a flat upper surface engagable with inner and outer magnetic poles of a solenoid. The outer rim also has flat upper and lower surfaces, respectively engagable with surfaces coplanar with the magnetic poles and the valve seat.

The rim has a thickness greater than that of armature by a differential dimension which establishes the stroke of the armature. The legs have a thickness less than that of the armature to permit flexing of the legs upon movement of the armature.

The member may be formed in layers including a first layer comprising the rim, legs and armature, a second layer formed on the first layer and comprising the rim and armature, and a third layer formed on the second layer and comprising the rim. Electroforming, metal etching or a combination of these processes may be used to form the armature/spacer member. The resulting member may be made to the desired dimensions with required flat sealing and mounting surfaces without additional machining or other finishing. A simple but effective member thus results.

These and other features and advantages of the invention will be more fully understood from the following description of certain specific embodiments of the invention taken together with the accompanying drawings.

DESCRIPTION OF THE PREFERRED EMBODIMENT

Figure 1:
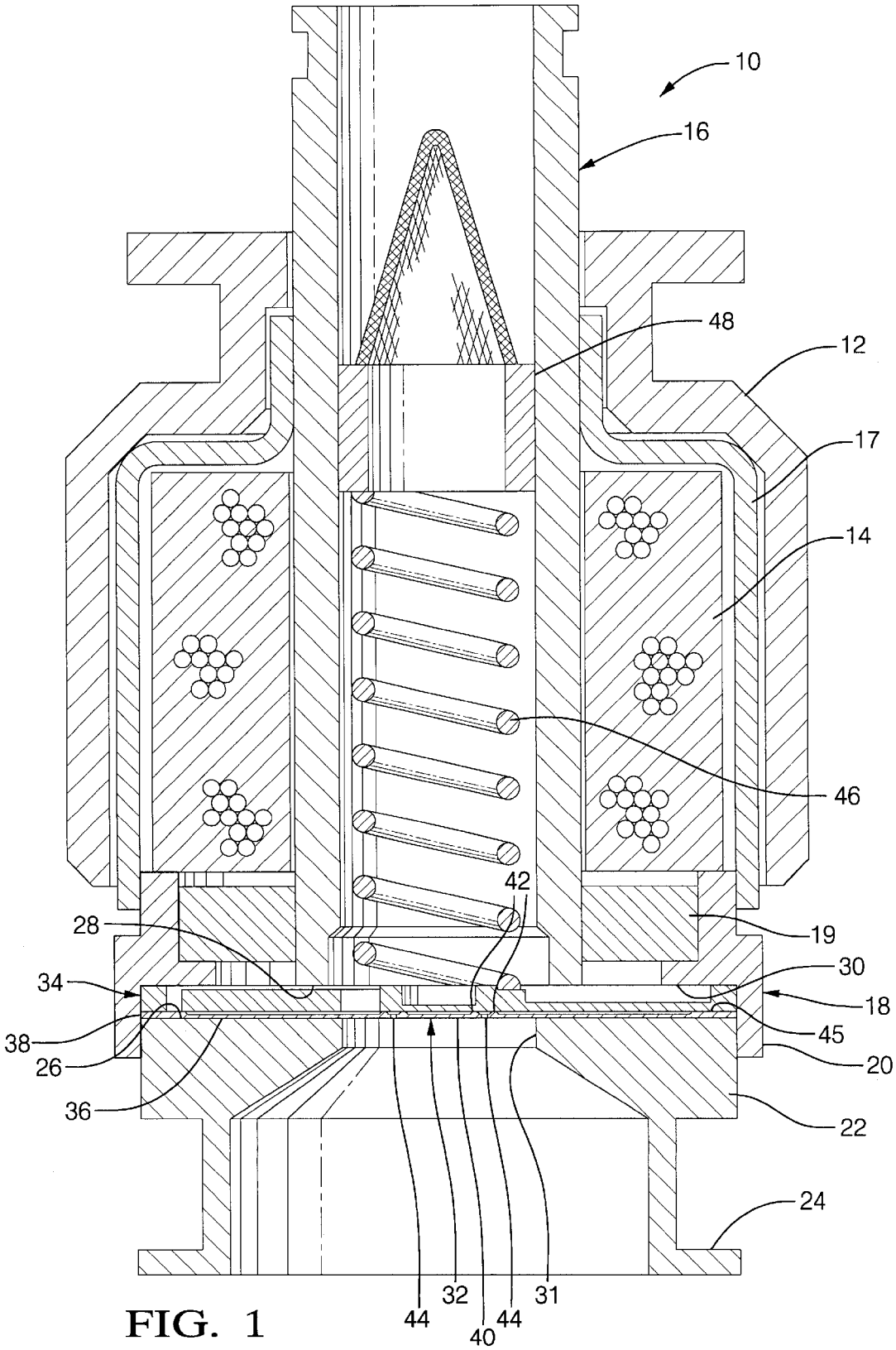
FIG. 1 is a cross-sectional view of an exemplary solenoid actuated fuel injector having an integral armature/spacer member according to the invention.

Referring first to FIG. 1 of the drawings in detail, numeral 10 generally indicates an exemplary solenoid actuated fu al injector for an engine. Injector 10 includes a non-magnetic cover 12 enclosing a solenoid coil 14. A fuel tube extends through the coil and acts as an inner magnetic pole 16. An outer strap 17 connects with the inner pole 16, extends around the coil 14 and connects with an annular member forming an outer magnetic pole 18. A nonmagnetic spacer 19 provides a seal between the inner and outer poles below the coil.

The outer pole 18 includes a skirt 20 that is fixed to a lower housing 22 defining an external seal groove 24. Housing 22 has a flat upper wall 26 that opposes and is spaced from coplanar flat lower surfaces 28, 30 of the inner and outer poles, respectively. The housing 22 also has a central opening 31 through the upper wall 26 and connecting with an enlarged open area below for the passage of fuel spray from the injector.

Disposed between the housing upper wall 26 and the magnetic pole lower surfaces 28, 30 is an injection valve comprising a valve seat and spray director unit 32, mounted on the housing upper wall 26, and an armature/spacer member 34. Seat/director unit 32 is made as an integral member including subject matter claimed in copending U.S. patent application Ser. No. 09/660,950, filed concurrently with the present application on Sep. 13, 2000. Unit 32 is shaped as a circular disk, which includes a flat lower surface 36 that seats against the flat upper wall 26 of the lower housing 22. A thickened outer rim or concentric outer ribs 38 form a periphery of the disk while one or more raised ribs in a central portion 40 of the disk form a valve seat 42. Spray holes 44 within the central portion act as a director plate to form a spray of fuel passing through the holes 44. The rim or outer ribs 38 and the valve seat 42 preferably have equal thickness dimensions so that the rim upper surface 45 is coplanar with the valve seat 42. A biasing spring 46, seats against a calibration sleeve 48 fixed in the pole 16 and engages member 34 for a purpose to be subsequently described.

Figure 2:
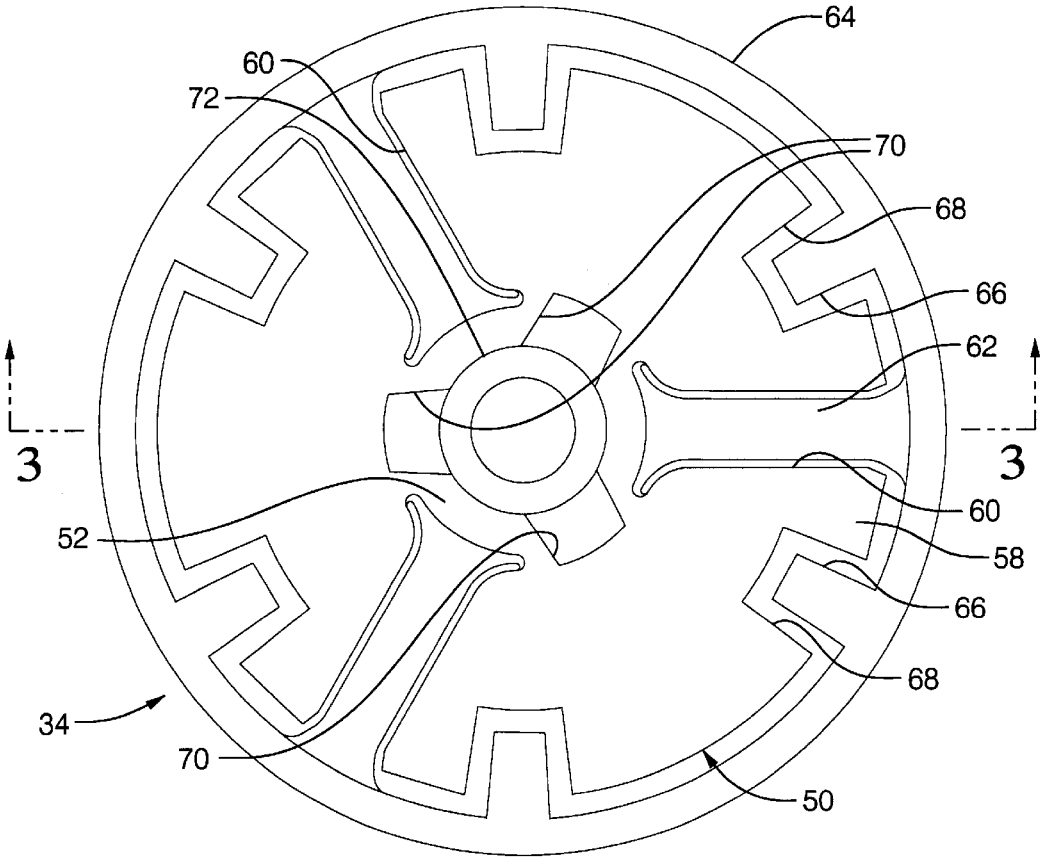
FIG. 2 is a top view of the integral member of FIG. 1.
Figure 3:
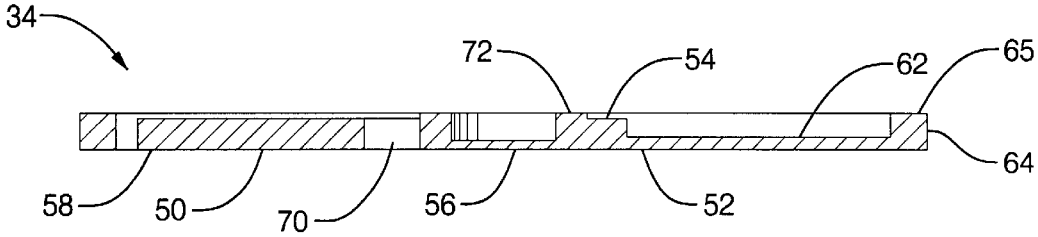
FIG. 3 is a cross-sectional view from the line 3—3 of FIG. 2.

The armature/spacer member 34 is formed in accordance with the present invention and is shown enlarged in FIGS. 2 and 3. Member 34 includes a movable armature 50 having a center portion 52 with a flat upper side 54 engaged by the spring 46 and engagable with the magnetic poles 16, 18. The spring biases a flat lower surface 56 of the armature against the valve seat 42 to cut off fuel flow through the injector. Armature 50 also includes an outer portion 58 having annularly spaced radial openings 60 extending outward from the center portion 52. A plurality of relatively thin flexible legs 62 extend radially out from the center portion 52 and connect with an outer rim 64 spaced outward of the armature 50. Rim 64 preferably has a flat upper surface 65 and may include inwardly extending portions 66 that extend into cutouts 68 in the armature outer portion 58. Fuel openings 70 are provided in the center portion 52. A raised inner guide 72 is also preferably provided on the center portion 52 to locate the lower end of the spring 46 against the armature 50.

The armature 50, legs 62 and rim 64 are formed as integral elements of member 34, in which the flat lower surface 56 preferably extends from the armature 50 through the legs 62 into the outer rim 64. The portions of the lower surface in the elements 50, 62, 64 of member 34 preferably remain coplanar while armature 50 is seated against the valve seat 42.

The thickness of the various elements may differ as needed to accomplish their various purposes. The legs 62 are made thin to maintain flexibility needed to allow axial movement of the armature. The armature 50 is made thicker to carry magnetic flux between the inner and outer poles 16, 18 of the injector when the coil 14 is energized. The rim 64 is made slightly thicker than the armature 50 to act as a spacer that is clamped between the rim or outer ribs 38 of the seat/director unit 32 and the outer magnetic pole 18 of the injector. The difference, or increase in thickness of the rim (spacer) 64 over the armature 50, establishes the allowable stroke of the armature from its closed position on the valve seat to its open position engaging the inner and outer poles 16, 18.

In operation of the injector in an engine, pressurized fuel is admitted to the full tube/inner pole 16 and flows through armature openings 70 to the upper surface of the valve seat/director unit 32, where it is blocked while the armature 50 remains seated against the valve seat 42. When the solenoid coil 14 is energized, armature 50 is drawn upward, with the upper side 54 against the magnetic poles 16, 18, by an axial displacement equal to the difference in thickness between the armature and the thicker outer rim 64. The legs 62 flex to allow this motion of the armature relative to the rim of the integral armature/spacer member 34. The upward stroke of the armature opens valve seat 42 and allows fuel flow through the spray holes 44 of the integral spray director. The fuel flow continues until the coil 14 is deenergized and the spring 46 again forces the armature 50 to engage the valve seat 42.

Figure 4:
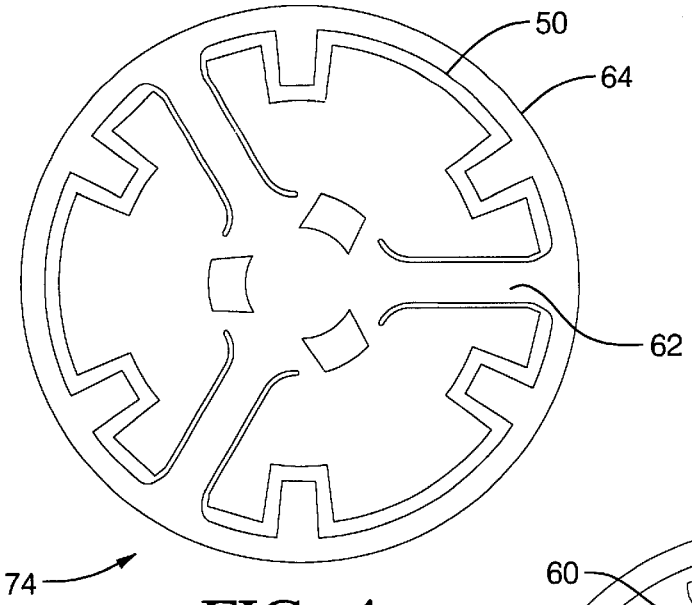
FIGS. 4–6 are top views of first, second and third metal layers applied in forming the integral member of FIGS. 2 and 3.
Figure 5:
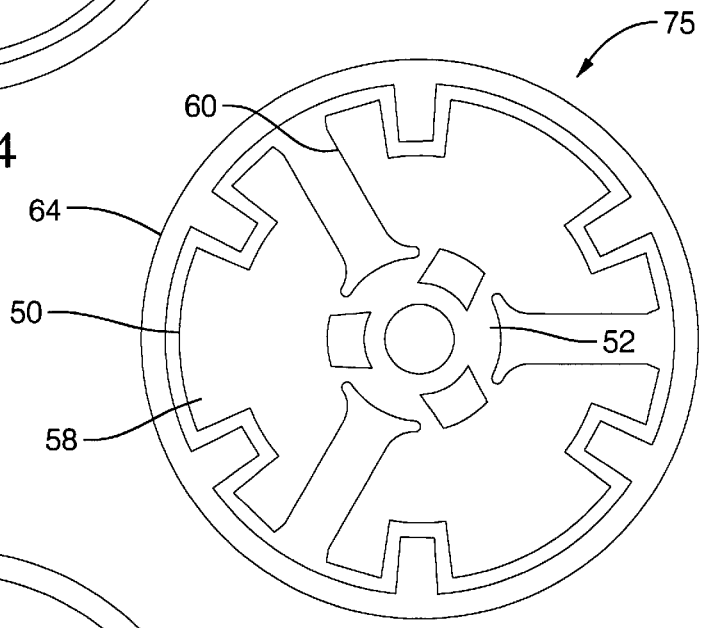
Figure 6:
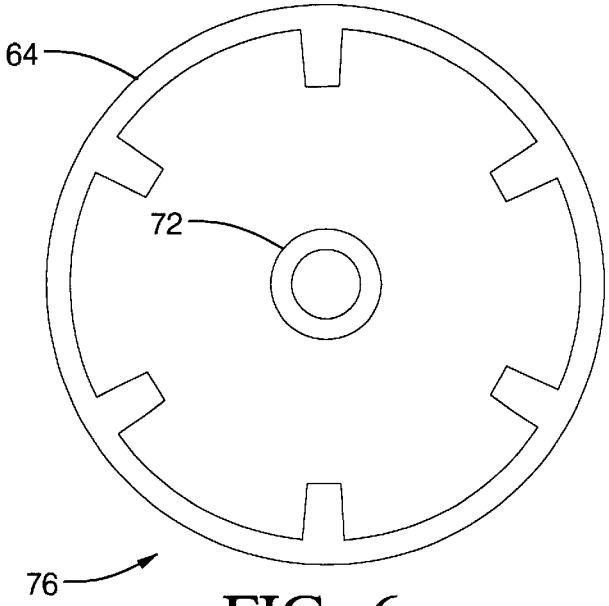

The armature/spacer member 34 of FIGS. 2 and 3 may be made by any suitable process. However, it has been particularly designed to permit manufacture by electroforming or a combination of metal etching with electroforming. FIGS. 4–6 illustrate the steps involved in certain processing methods in which the member 34 is formed in layers.

FIG. 4 illustrates a first layer 74, which includes parts of all elements of the member 34. Layer 74 may be electroformed of nickel or etched from a martensitic stainless steel mandrel. In either case, the first layer 74 has the thickness of the flexible legs 62. The material is selected to meet the requirements of the legs in maintaining the armature 50 centered while allowing axial stroking of the armature between its open and closed positions.

FIG. 5 illustrates on a second layer 75 of iron, which is preferably eletroformed onto the first layer. The thicknesses of the armature 50 and the outer rim 64 are thereby increased to the desired thickness of the armature. However, the legs are not included since they have been formed in the desired thickness and material in the first layer 74.

FIG. 6 illustrates a third layer 76 of iron, which is electroformed onto the second layer 75. The third layer 76 increases the thickness of the outer rim 64 to its desired thickness by adding the rim thickness needed to establish the desired stroke of the armature 50. The thickness of the outer portion 58 of the armature 50 is, of course, not increased by addition of the third layer 76. Preferably, the third layer also adds the inner guide 72 to the center portion 52 of the armature, since this can be done with the same electroforming step.

The completed layered armature/spacer member 34 is formed by electroforming, or a combination with metal etching, to net shape dimensions that do not require further metal finishing steps. Thus, an integral multiple function armature, guide and spacer is formed by known processes without further assembly or machining steps being required.

Figure 7:
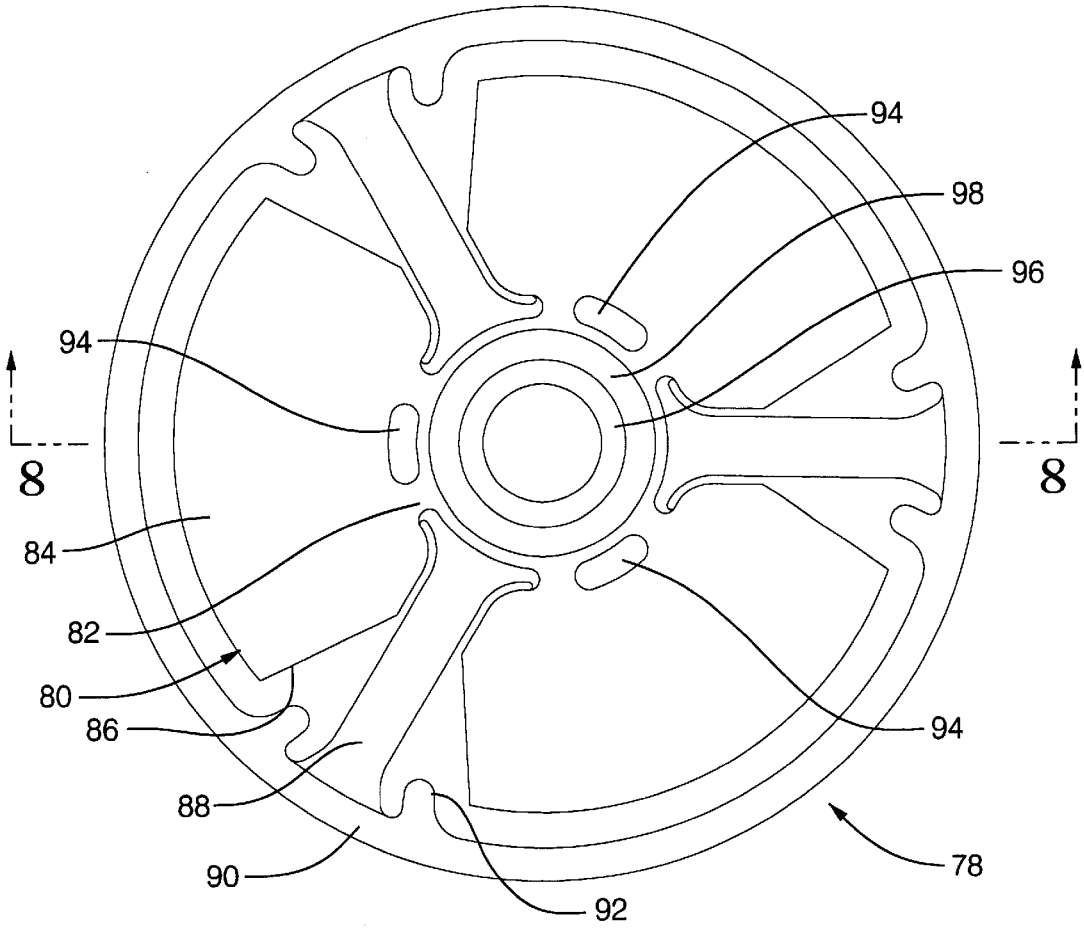
FIGS. 7 and 8 are views similar to FIGS. 2 and 3 respectively but showing an alternative embodiment of integral armature/spacer member.
Figure 8:
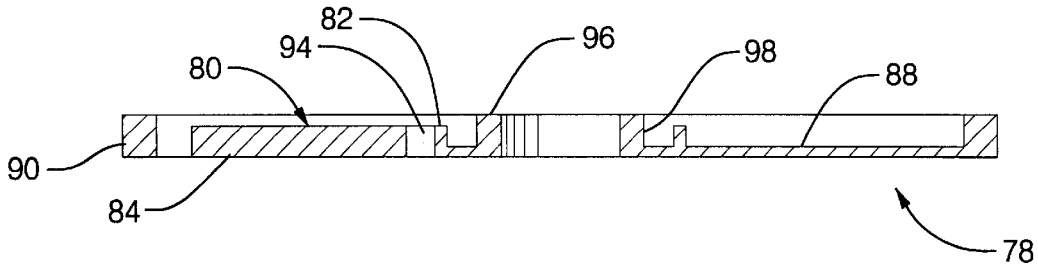

FIGS. 7 and 8 illustrate an exemplary alternative embodiment of armature/spacer member 78 according to the invention. Member 78 is similar to member 34 in that it includes a movable armature 80 having a center portion 82. Armature 80 also includes an outer portion 84 having annularly spaced radial openings 86 extending outward from the center portion 82. A plurality of relatively thin flexible legs 88 extend radially out from the center portion 82 and connect with an outer rim 90 spaced outward of the armature 80. Rim 90 includes inwardly extending portions 92 that extend into flared portions of the radial openings 86 in the armature outer portion 84. Fuel openings 94 are provided in the center portion 82. A raised inner guide 96 is also provided on the center portion 82 to locate the lower end of a biasing spring 46 against the armature 80. Outside the guide 96, an annular recess 98 is provided to receive the spring 46.

The use, manufacture and general characteristics of member 78 are otherwise similar to those of member 34, illustrated in FIGS. 1–6 so that further discussion is not required.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. An injection valve armature/spacer formed as an integral multiple function multiple thickness member for an engine fuel injector, said member comprising:

an armature including a center portion having an upper side engagable by a biasing spring and an outer portion with spaced radial openings extending outward from the center portion;

an outer rim spaced outward of said armature; and a plurality of flexible legs extending radially through the radial openings and connecting the center portion of the armature with the outer rim;

said armature having a flat lower surface engagable with a valve seat and an upper side attractable toward inner and outer magnetic poles of a solenoid, and said outer rim being engagable with surfaces coplanar with said poles and said valve seat, the rim having a thickness greater than that of the armature by a differential dimension establishing a stroke of the armature, and the legs having a thickness less than that of the armature to permit flexing of the legs upon movement of the armature.

2. The invention of claim 1 wherein the outer rim of the armature has flat upper and lower surfaces.

3. The invention of claim 2 wherein said armature upper side is flat and engagable with at least one of the inner and outer poles.

4. The invention of claim 1 wherein said member is formed by at least one of electroforming and metal etching processes.

5. The invention of claim 1 wherein said member is formed in layers including a first layer comprising the rim, legs and armature, a second layer formed on the first layer and comprising the rim and armature, and a third layer formed on the second layer and comprising the rim.

6. The invention of claim 5 wherein said second layer of the armature is formed of a magnetic material.

7. The invention of claim 6 wherein said second layer is iron.

8. The invention of claim 1 wherein said armature includes fuel openings adjacent the center portion for conducting fuel to a valve seat.

* * * * *